US007353785B2

(12) United States Patent
Kondo et al.

(10) Patent No.: US 7,353,785 B2
(45) Date of Patent: Apr. 8, 2008

(54) COMPRESSION RATIO VARIABLE DEVICE OF INTERNAL COMBUSTION ENGINE

(75) Inventors: Takashi Kondo, Wako (JP); Makoto Hirano, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 372 days.

(21) Appl. No.: 10/519,940

(22) PCT Filed: Jul. 2, 2003

(86) PCT No.: PCT/JP03/08389

§ 371 (c)(1),
(2), (4) Date: Sep. 12, 2005

(87) PCT Pub. No.: WO2004/007932

PCT Pub. Date: Jan. 22, 2004

(65) Prior Publication Data

US 2006/0090715 A1 May 4, 2006

(30) Foreign Application Priority Data

Jul. 12, 2002 (JP) ..... 2002-204558

(51) Int. Cl.
*F02D 15/02* (2006.01)

(52) U.S. Cl. ..... 123/48 B; 123/78 B

(58) Field of Classification Search ..... 123/48 B, 123/78 B

See application file for complete search history.

(56) References Cited

U.S. PATENT DOCUMENTS 5,417,185 A * 5/1995 Beattie ..... 123/48 B

FOREIGN PATENT DOCUMENTS

JP 58-79029 A 5/1983
JP 63-41647 A 2/1988
JP 63-143342 A 6/1988
JP 63-108537 A 7/1988
JP 3-185233 A 8/1991
JP 7-113330 A 12/1995
JP 11-117779 A 4/1999

* cited by examiner

*Primary Examiner*—Noah P. Kamen
(74) *Attorney, Agent, or Firm*—Birch, Stewart, Kolasch & Birch, LLP

(57) ABSTRACT

An internal combustion engine variable compression ratio system is provided that includes a piston inner (5*a*), a piston outer (5*b*) that is fitted around the outer periphery of the piston inner (5*a*) so that it can slide only in the axial direction and is capable of moving between a low compression ratio position (L) and a high compression ratio position (H), a raising member (14) that can pivot around axes of the piston inner and outer (5*a*, 5*b*) between a non-raised position (A) and a raised position (B), and an actuator (20) connected to the member (14) and pivoting it to the non-raised position (A) or the raised position (B), in which piston outer high compression ratio position latching means (30*b*) is disposed between the piston inner (5*a*) and the piston outer (5*b*) and operates, when the piston outer (5*b*) has reached the high compression ratio position (H), so as to prevent relative axial movement of the piston inner (5*a*) and the piston outer (5*b*). It is thereby possible to provide a variable compression ratio system that enables the piston outer to be moved to the low compression ratio position and the high compression ratio position simply and reliably without rotating the piston outer.

4 Claims, 13 Drawing Sheets

COMPRESSION RATIO VARIABLE DEVICE OF INTERNAL COMBUSTION ENGINE

FIELD OF THE INVENTION

The present invention relates to an internal combustion engine variable compression ratio system and, in particular, to an improvement thereof in which a piston includes a piston inner and a piston outer, the piston inner being connected to a connecting rod via a piston pin, and the piston outer, while being connected to the piston inner so as to have an outer end face thereof facing a combustion chamber, being capable of moving between a low compression ratio position close to the piston inner and a high compression ratio position close to the combustion chamber, the compression ratio of the engine being decreased by moving the piston outer to the low compression ratio position, and the compression ratio being increased by moving the piston outer to the high compression ratio position.

BACKGROUND ART

Conventionally, with regard to such an internal combustion engine variable compression ratio system, there is a known system (1) in which a piston outer is screwed around the outer periphery of a piston inner, and rotating the piston outer forward and backward so that it approaches and recedes from the piston inner moves it to a low compression ratio position and a high compression ratio position (for example, Japanese Patent Application Laid-open No. 11-117779), and a known system (2) in which a piston outer is fitted in an axially slidable manner around the outer periphery of a piston inner, an upper hydraulic chamber and a lower hydraulic chamber are formed between the piston inner and the piston outer, and supplying hydraulic pressure alternately to these hydraulic chambers moves the piston outer to a low compression ratio position and a high compression ratio position (for example, Japanese Patent Publication No. 7-113330).

However, in the above-mentioned system (1), since it is necessary to rotate the piston outer in order to move it to the low compression ratio position and the high compression ratio position, the shape of the top face of the piston outer cannot be set freely so as to match the shape of the roof of a combustion chamber and the positional arrangement of intake and exhaust valves, and it is difficult to increase the compression ratio of the engine sufficiently at the high compression ratio position. Furthermore, in the above-mentioned system (2), particularly when the piston outer is at the high compression ratio position, since a large thrust load imposed on the piston outer during an expansion stroke of the engine is borne by the hydraulic pressure of the upper hydraulic chamber, it is necessary for the upper hydraulic chamber to have a seal that can withstand high pressure and, moreover, if bubbles are generated in the upper hydraulic chamber, since the high compression ratio position of the piston outer becomes unstable, it is necessary to provide means for removing such bubbles, thus inevitably increasing the overall cost.

DISCLOSURE OF THE INVENTION

The present invention has been accomplished under the above-mentioned circumstances, and it is an object thereof to provide an internal combustion engine variable compression ratio system that enables a piston outer to be moved to a low compression ratio position and a high compression ratio position simply and reliably without rotating the piston outer.

In order to attain this object, in accordance with a first aspect of the present invention, there is provided an internal combustion engine variable compression ratio system that includes a piston inner connected to a connecting rod via a piston pin; a piston outer that, while being fitted around the outer periphery of the piston inner so as to be capable of sliding only in the axial direction and having an outer end face thereof facing a combustion chamber, is capable of moving between a low compression ratio position close to the piston inner and a high compression ratio position close to the combustion chamber; a raising member that is disposed between the piston inner and the piston outer, pivots around axes of the piston inner and the piston outer between a non-raised position at which movement of the piston outer to the low compression ratio position is allowed and a raised position at which the piston outer is held at the high compression ratio position, and allows, at the non-raised position, movement of the piston outer between the low compression ratio position and the high compression ratio position by virtue of a spontaneous external force; an actuator connected to the raising member; piston outer stopper means that is provided between the piston inner and the piston outer, prevents movement of the piston outer beyond the high compression ratio position, and allows movement of the piston outer toward the low compression ratio position; and piston outer low compression ratio position latching means that is disposed between the piston inner and the piston outer and operates, when the piston outer has reached the low compression ratio position, so as to prevent relative axial movement of the piston inner and the piston outer; the system further including piston outer high compression ratio position latching means that is disposed between the piston inner and the piston outer and operates, when the piston outer has reached the high compression ratio position, so as to prevent relative axial movement of the piston inner and the piston outer.

The spontaneous external force includes combustion pressure in the combustion chamber, compression pressure of a gas mixture, frictional resistance that the piston outer receives from an inner face of a cylinder bore, the inertial force of the piston outer, intake negative pressure acting on the piston outer, etc.

In accordance with the first aspect, if the raising member is pivoted to the non-raised position by means of the actuator while releasing the piston outer high compression ratio position latching means, the raising member allows movement of the piston outer to the low compression ratio position. When the piston outer thus moves to the low compression ratio position by virtue of a spontaneous external force, operation of the piston outer low compression ratio position latching means enables the piston outer to be held at the low compression ratio position.

Furthermore, if the raising member is pivoted from the non-raised position to the raised position by means of the actuator while releasing the piston outer low compression ratio position latching means, the piston outer moves by a spontaneous external force to the high compression ratio position where it is restrained by the piston outer stopper means, and is held by the raising member at the raised position.

Moreover, as described above, when the piston outer has reached the high compression ratio position, since relative axial movement of the piston inner and the piston outer is prevented by operation of the piston outer high compression ratio position latching means, when the piston outer low compression ratio position latching means is released and the piston outer is moved from the low compression ratio position to the high compression ratio position by virtue of a spontaneous external force, even if there is a delay in movement of the raising member to the raised position and the piston outer receives a kick from the piston outer stopper means, the kick is borne by the piston outer high compression ratio position latching means, thus preventing the piston outer from bouncing back from the high compression ratio position and thereby reliably holding the piston outer at the high compression ratio position.

Since the piston outer does not rotate relative to the piston inner, it can move between the low compression ratio position and the high compression ratio position, and the shape of the top face of the piston outer, which faces the combustion chamber, can match the shape of the combustion chamber, thereby increasing effectively the compression ratio when the piston outer is at the high compression ratio position. Moreover, regardless of whether the piston outer is at the low compression ratio position or the high compression ratio position, during the expansion stroke of the engine, a large thrust that the piston outer receives from the combustion chamber is received by the raising member. In this way, the thrust is prevented from acting on the actuator, and it is therefore possible to reduce the capacity of the actuator and consequently the dimensions thereof. When the actuator is of a hydraulic type, since the thrust does not act thereon, a high pressure seal is not needed, and even if some bubbles form in a hydraulic chamber, the high compression ratio position of the piston outer will not become unstable.

Furthermore, in accordance with a second aspect of the present invention, in addition to the first aspect, there is provided the internal combustion engine variable compression ratio system wherein the piston outer high compression ratio position latching means includes a peripheral first latching channel formed on an inner peripheral face of the piston outer, a first latching member that is supported by the piston inner and moves between an operating position where it can engage with the first latching channel when the piston outer has reached the high compression ratio position and a retracted position where it disengages from the first latching channel, and driving means for driving the first latching member to these two positions, and the piston outer low compression ratio position latching means includes a peripheral second latching channel formed on an inner peripheral face of the piston outer, a second latching member that is supported by the piston inner and moves between an operating position where it can engage with the second latching channel when the piston outer has reached the low compression ratio position and a retracted position where it disengages from the second latching channel, and driving means for driving the second latching member to these two positions.

In accordance with the second aspect, the first and second latching members, which are both supported by the piston inner, enable the piston outer to be held at the low compression ratio position or at the high compression ratio position, thereby contributing to a simplification of the arrangement of the piston outer low compression ratio position latching means and the piston outer high compression ratio position latching means.

Moreover, in accordance with a third aspect of the present invention, in addition to the second aspect, there is provided the internal combustion engine variable compression ratio system wherein the first and second latching members are formed from a first arm and a second arm that extend in opposite directions from each other from the center of swing of a single latching lever swingably and axially supported by the piston inner, and the latching lever is swung by single driving means so as to make the first and second arms engage alternately with the first and second latching channels.

In accordance with the third aspect, the piston outer low compression ratio position latching means and the piston outer high compression ratio position latching means can be formed from the single latching lever having the first and second arms and the driving means shared between the two arms, thus contributing to further simplification of the arrangement thereof.

Furthermore, in accordance with a fourth aspect of the present invention, in addition to the third aspect, there is proposed the internal combustion engine variable compression ratio system wherein the driving means is formed from an operating spring that urges one of the first and second arms in a direction in which it engages with the corresponding latching channel, and a hydraulic piston that is capable of receiving a hydraulic pressure from a hydraulic pressure source and pushing the other of the first and second arms in a direction in which it engages with the corresponding latching channel.

In accordance with the fourth aspect, simply controlling the supply and release of hydraulic pressure to and from the hydraulic piston in cooperation with the operating spring enables the first and second arms to be operated alternately, thus simplifying the arrangement of the driving means.

BEST MODE FOR CARRYING OUT THE INVENTION

Modes for carrying out the present invention are explained below with reference to embodiments shown in the attached drawings.

The first embodiment of the present invention is now explained with reference to FIG. 1 to FIG. 12.

Figure 1:
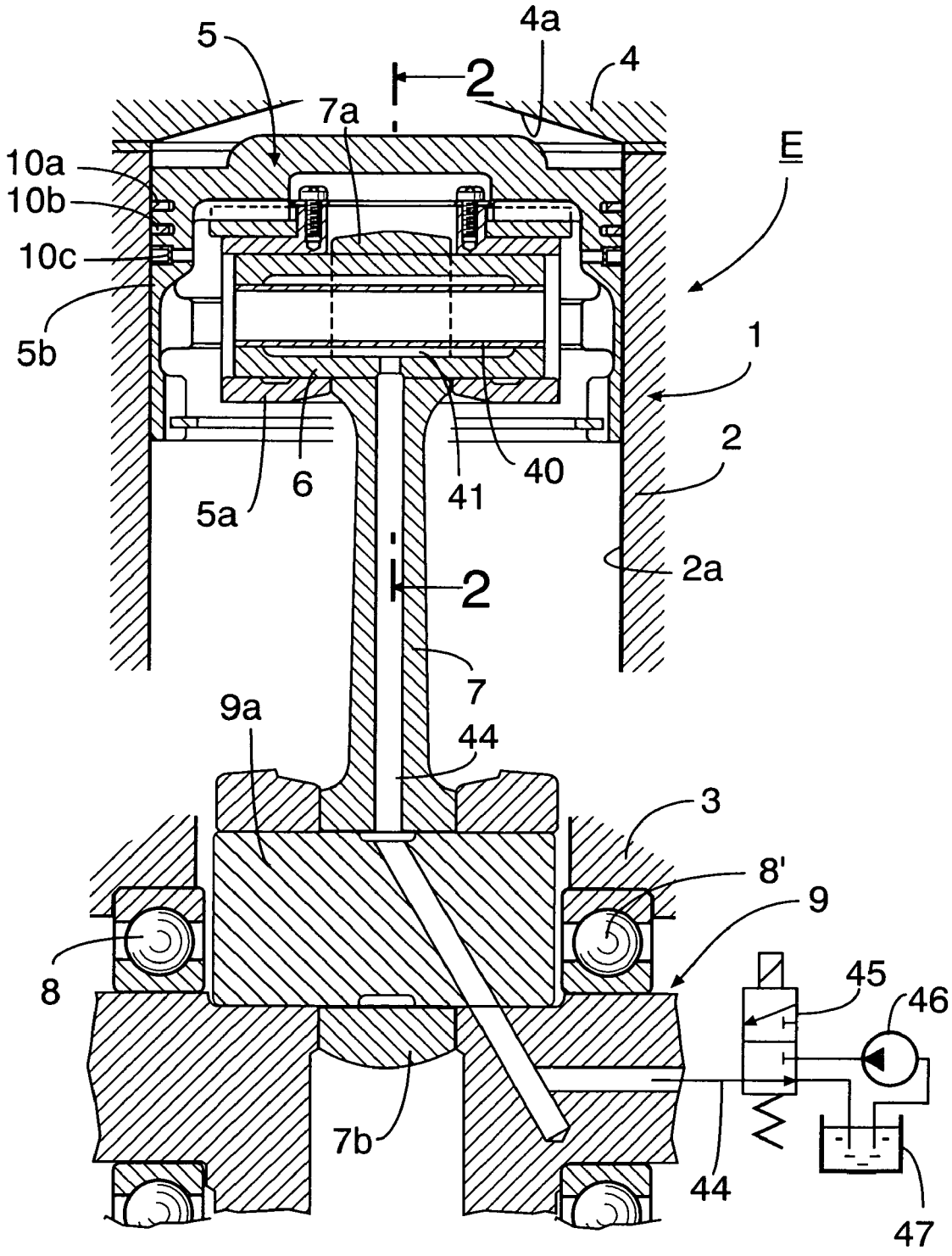
FIG. 1 is a vertical sectional front view of an essential part of an internal combustion engine provided with a variable compression ratio system related to a first embodiment of the present invention.
Figure 2:
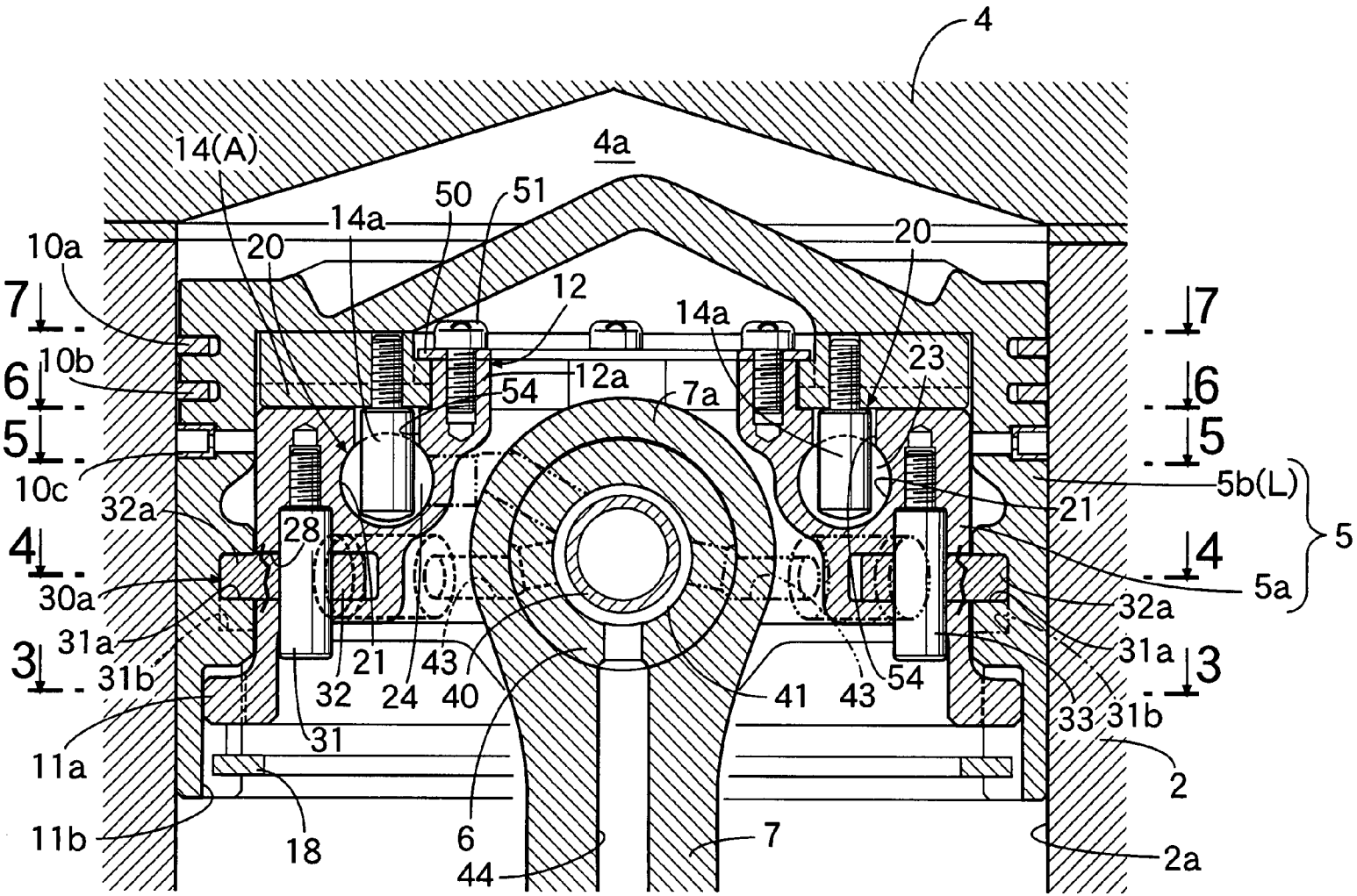
FIG. 2 is an enlarged sectional view along line 2-2 in FIG. 1 and shows a low compression ratio state.

In FIG. 1 and FIG. 2, an engine main body 1 of an internal combustion engine E includes a cylinder block 2 having a cylinder bore 2*a*, a crankcase 3 joined to the lower end of the cylinder block 2, and a cylinder head 4 joined to the upper end of the cylinder block 2 and having a combustion chamber 4*a* extending from the cylinder bore 2*a*. A piston 5 is fitted slidably in the cylinder bore 2*a*, a little end 7*a* of a connecting rod 7 is connected to the piston 5 via a piston pin 6, and a big end 7*b* of the connecting rod 7 is connected via a pair of left and right bearings 8 and 8' to a crankpin 9*a* of a crankshaft 9 rotatably supported in the crankcase 3.

The piston 5 includes a piston inner 5*a* and a piston outer 5*b*, the piston inner 5*a* being connected to the little end 7*a* of the connecting rod 7 via the piston pin 6, and the piston outer 5*b*, whose top face faces the combustion chamber 4*a*, being slidably fitted onto an outer peripheral face of the piston inner 5*a* and into an inner peripheral face of the cylinder bore 2*a*. A plurality of piston rings 10*a* to 10*c* are fitted around the outer periphery of the piston outer 5*b*, the plurality of piston rings 10*a* to 10*c* being in intimate sliding contact with the inner peripheral face of the cylinder bore 2*a*.

Figure 3:
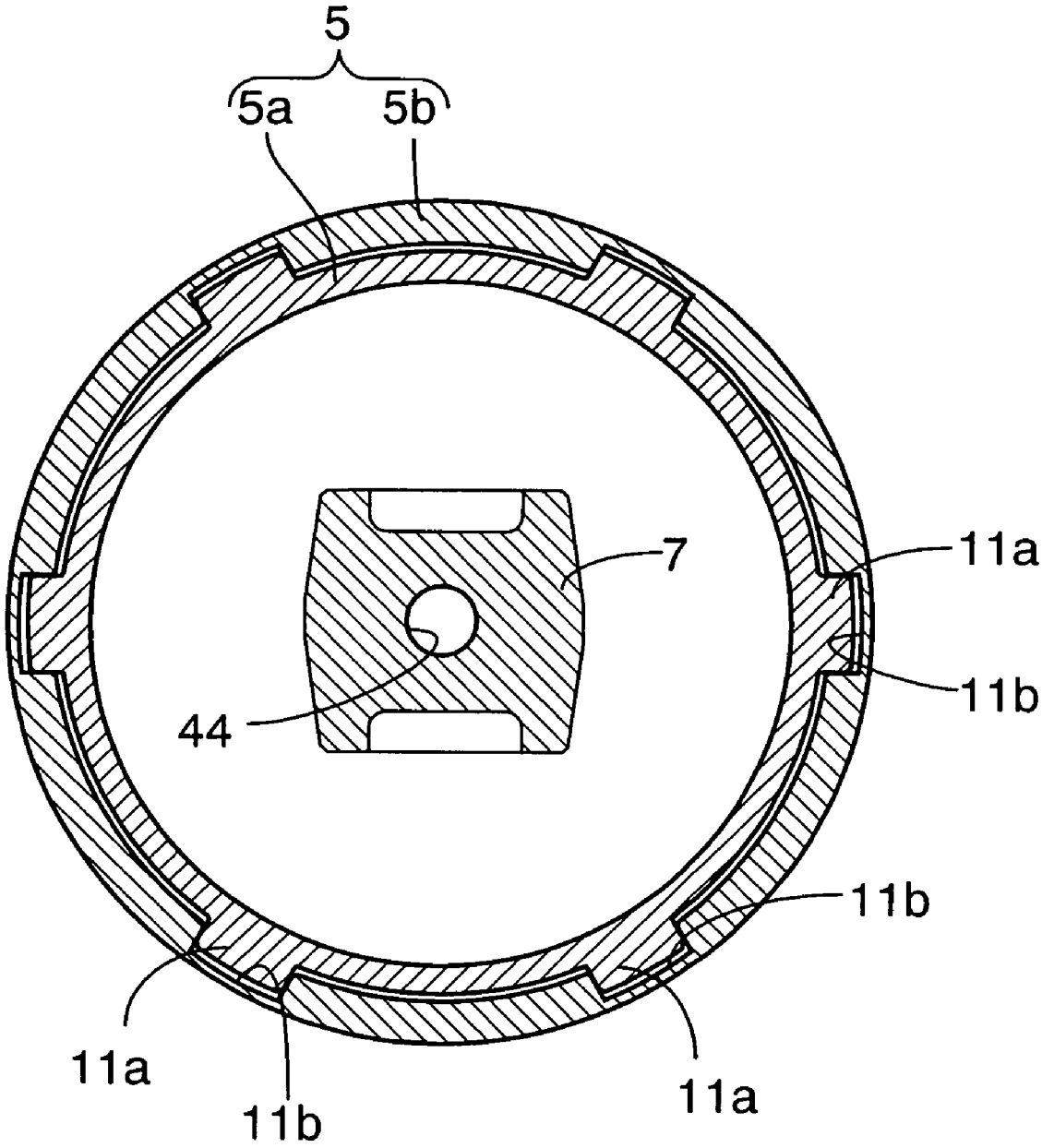
FIG. 3 is a sectional view along line 3-3 in FIG. 2.
Figure 6:
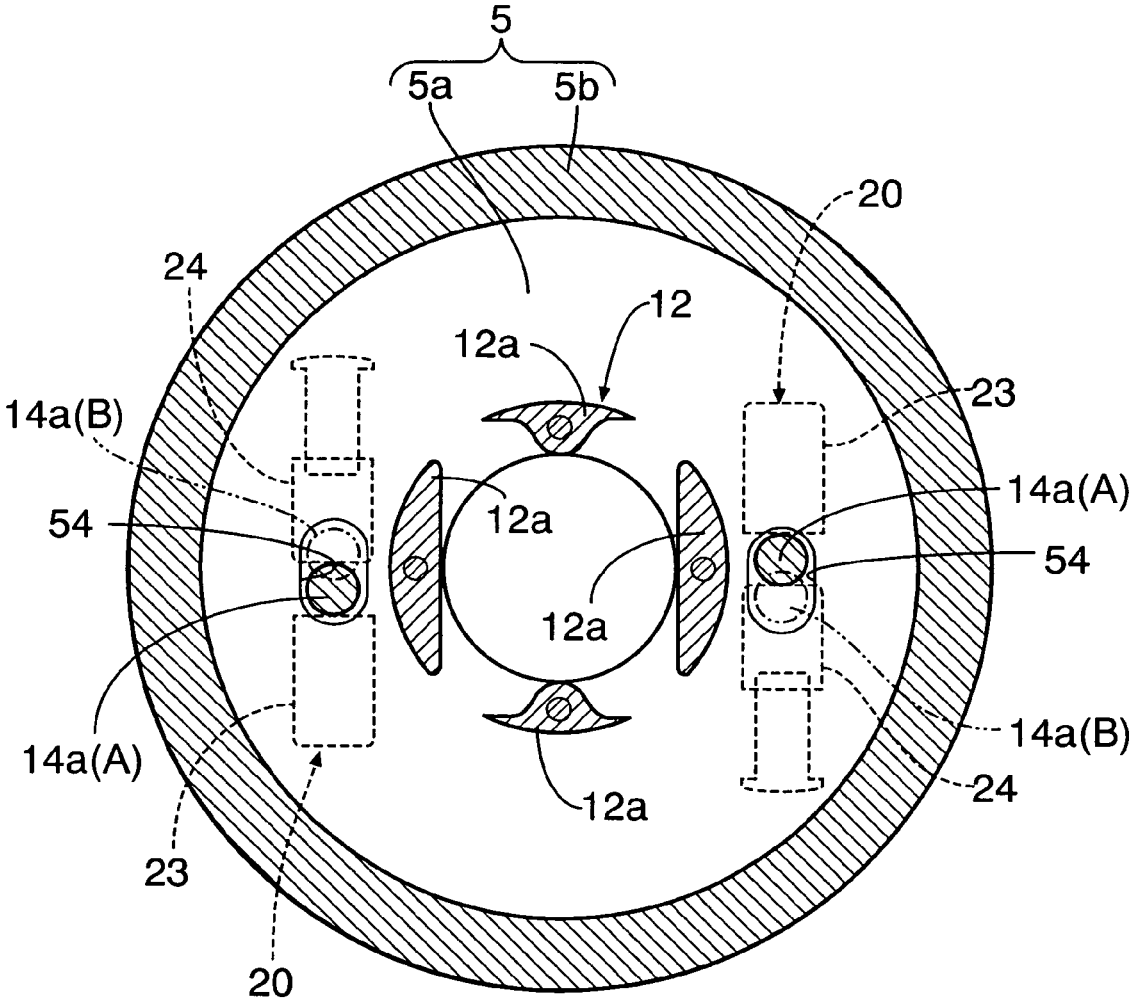
FIG. 6 is a sectional view along line 6-6 in FIG. 2.
Figure 7:
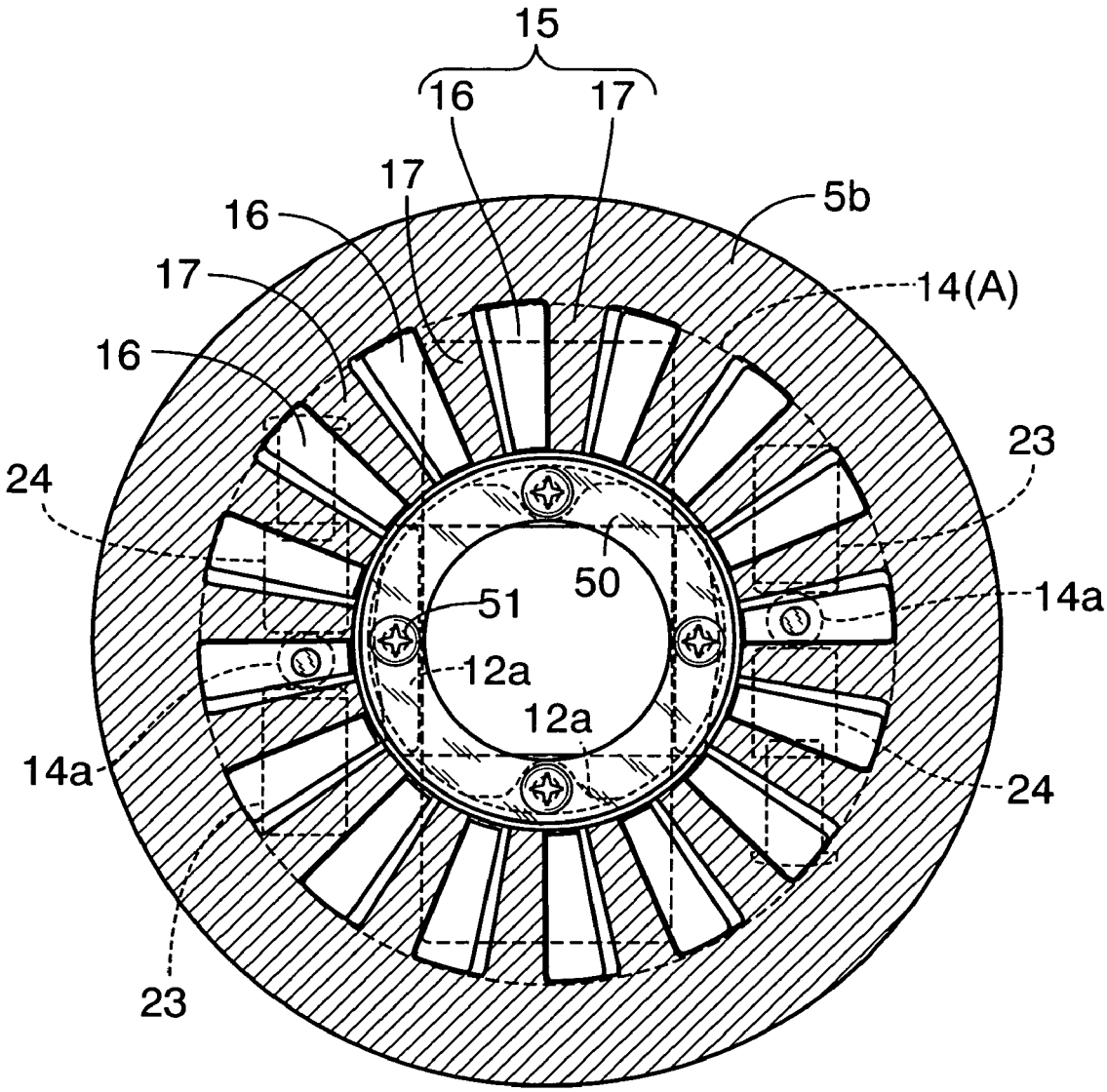
FIG. 7 is a sectional view along line 7-7 in FIG. 2.
Figure 8:
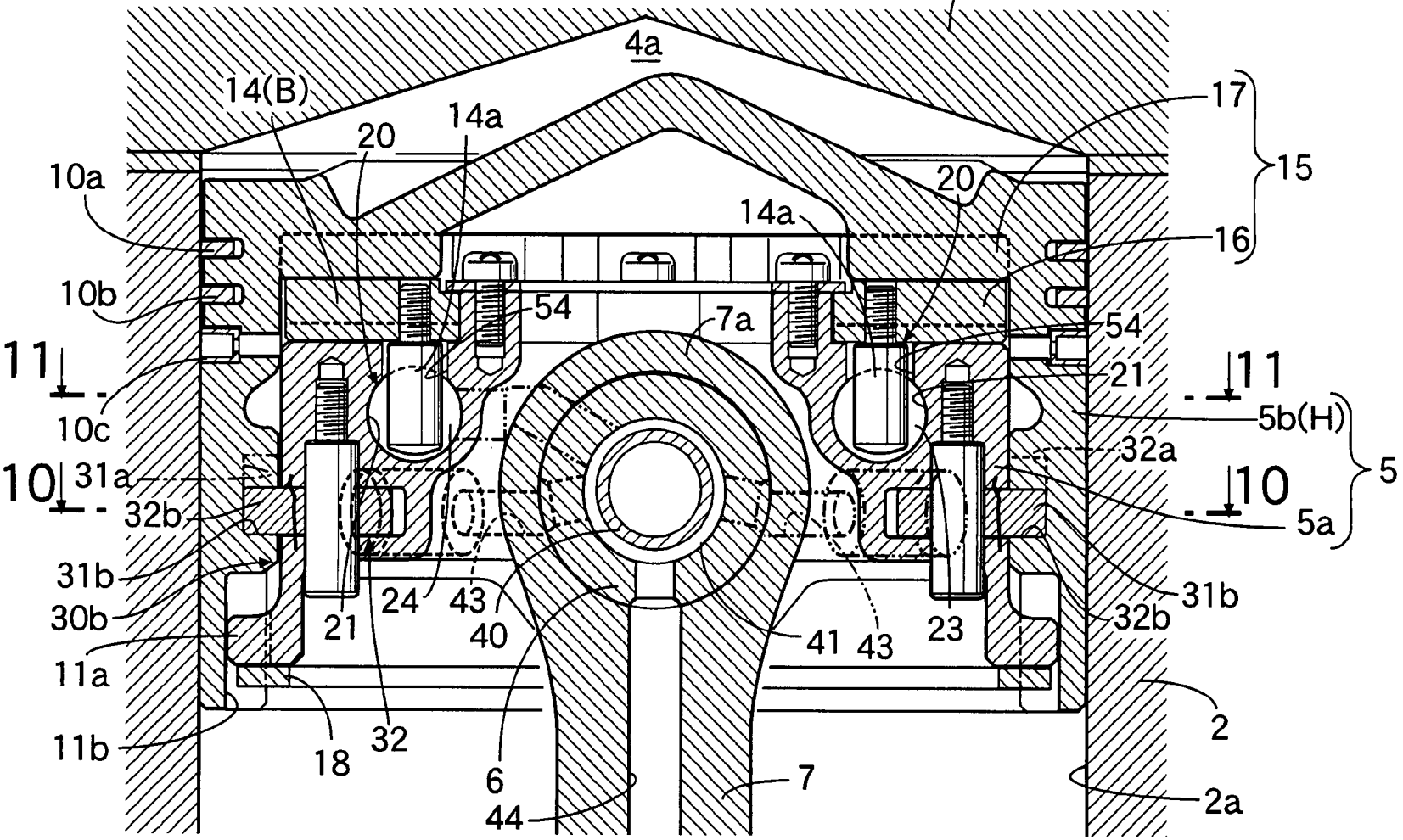
FIG. 8 is a is a view, corresponding to FIG. 2, showing a high compression ratio state.

As shown in FIG. 2 and FIG. 3, a plurality of spline teeth 11*a* and spline grooves 11*b* extending in the axial direction of the piston 5 and engaging with each other are formed on the sliding mating faces of the piston inner and outer 5*a* and 5*b* respectively, thereby preventing relative rotation of the piston inner and outer 5*a* and 5*b* around their axes In FIG. 2 and FIG. 6, an annular raising member 14 is mounted on an upper face of the piston inner 5*a*, the raising member 14 being fitted pivotably around a pivot portion 12 projectingly provided integrally with the upper face of the piston inner 5*a*, and a retaining ring 50 is secured to an upper face of the pivot portion 12 by means of a screw 51, the retaining ring 50 retaining an upper face of the raising member 14 so as to prevent it from disengaging from the pivot portion 12. The pivot portion 12 is divided into a plurality (four in the figure) of blocks 12*a* so as to accept the little end 7*a* of the connecting rod 7.

The raising member 14 is capable of reciprocatingly pivoting between a non-raised position A and a raised position B set around the axis of the raising member 14, and a cam mechanism 15 is provided between the raising member 14 and the piston outer 5*b*, the cam mechanism 15 holding the piston outer 5*b* alternately at a low compression ratio position L close to the piston inner 5*a* (see FIG. 2) and a high compression ratio position H close to the combustion chamber 4*a* (see FIG. 8) accompanying the reciprocating pivoting of the raising member 14.

As clearly shown in FIG. 7 and FIG. 11A to FIG. 11C, the cam mechanism 15 is formed from a plurality of protruding first cams 16 formed on the upper face of the raising member 14, and a plurality of protruding second cams 17 formed on a lower face of a top wall of the piston outer 5*b*, and these first and second cams 16 and 17 are arranged alternately side by side in the peripheral direction when the raising member 14 is at the non-raised position A, thus allowing the piston outer 5*b* to move to the low compression ratio position L or the high compression ratio position H.

Side faces of the first cams 16 and the second cams 17, which are arranged in the peripheral direction of the raising member 14, form perpendicular faces 16*a* and 17*a* rising substantially vertically from the bases of the cams 16 and 17, and flat top faces 16*b* and 17*b*, which connect upper edges of the perpendicular faces 16*a* and 17*a*, are arranged so that, when the raising member 14 has reached the raised position B, the flat top faces 16*b* and 17*b* abut against each other and hold the piston outer 5*b* at the high compression ratio position H. In this way, forming the side faces of the first and second cams 16 and 17 as the perpendicular faces 16*a* and 17*a* enables gaps between adjacent cams 16 and 17 arranged in the peripheral direction to be reduced and the total areas of the top faces 16*b* and 17*b* of the cams 16 and 17 to be made large.

As restraining means for preventing the piston outer 5*b* from moving toward the combustion chamber 4*a* beyond the high compression ratio position H when the piston outer 5*b* has reached the high compression ratio position H, a stopper ring 18, which is latched onto an inner peripheral face of a lower end part of the piston outer 5*b*, abuts against a lower end face of the piston inner 5*a*.

Provided between the piston inner 5*a* and the raising member 14 is an actuator 20 for pivoting the raising member 14 to the non-raised position A or the raised position B. This actuator 20 is explained with reference to FIG. 2, FIG. 5, and FIG. 6.

The piston inner 5*a* is provided with a pair of bottomed cylinder holes 21 extending parallel to the piston pin 6 on either side thereof, and a long hole 54 running through an upper wall of a middle section of each of the cylinder holes 21. A pair of pressure-bearing pins 14*a* projectingly provided integrally with a lower face of the raising member 14 and arranged on a diameter thereof run through the long holes 54 and face the cylinder holes 21. The long holes 54 are arranged so that the pressure-bearing pins 14*a* are not prevented from moving together with the raising member 14 between the non-raised position A and the raised position B.

An operating plunger 23 and a bottomed cylindrical return plunger 24 are fitted slidably in each of the cylinder holes 21 with the corresponding pressure-bearing pin 14*a* disposed therebetween. In this arrangement, the operating plungers 23 and the return plungers 24 are each disposed centrosymmetrically relative to the axis of the piston 5.

A first hydraulic chamber 25 is defined within each of the cylinder holes 21, the inner end of the operating plunger 23 facing the first hydraulic chamber 25, and when hydraulic pressure is supplied to the chamber 25 the operating plunger 23 receives the hydraulic pressure and pivots the raising member 14 to the raised position B via the pressure-bearing pin 14*a*.

Figure 10:
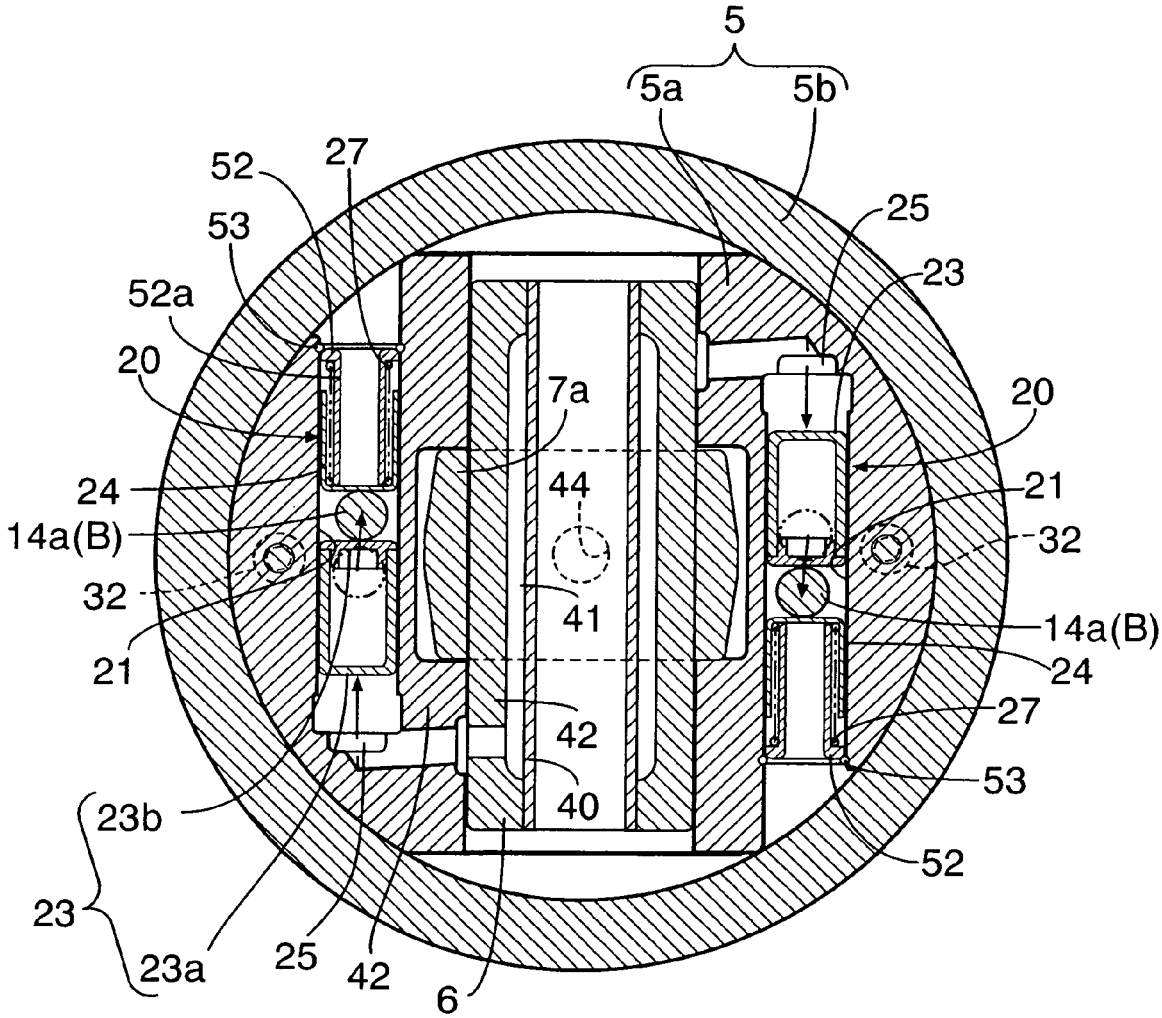
FIG. 10 is a sectional view along line 10-10 in FIG. 8, FIGS. 11A to 11C are diagrams for explaining the operation of a raising member.

The non-raised position A of the raising member 14 is defined by the pressure-bearing pin 14*a* abutting against the tip of the operating plunger 23 that abuts against the base of the corresponding cylinder hole 21 (see FIG. 5), and the raised position B of the raising member 14 is defined by the pressure-bearing pin 14*a* abutting against the tip of the return plunger 24 that abuts against a skirt portion 52*a* of a spring retaining ring 52 (see FIG. 10). In this way, when the raising member 14 is at the non-raised position A, adjacent first and second cams 16 and 17 are prevented from contacting each other via their side faces (see FIG. 11A), thereby enabling the piston outer 5*b* to move to the high compression ratio position H smoothly.

The raising member 14 and the actuator 20 allow the piston outer 5*b* to move between the low compression ratio position L and the high compression ratio position H by virtue of a spontaneous external force such as combustion pressure in the combustion chamber 4*a*, compression pressure of a gas mixture, the inertial force of the piston outer 5*b*, frictional resistance that the piston outer 5*b* receives from the inner face of the cylinder bore 2*a*, or intake negative pressure acting on the piston outer 5*b*, which act so that the piston inner and outer 5*a* and 5*b* are moved toward or away from each other in the axial direction.

Provided between the piston inner 5*a* and the piston outer 5*b* are piston outer low compression ratio position latching means 30*a* and piston outer high compression ratio position latching means 30*b*, the piston outer low compression ratio position latching means 30*a* latching the piston outer 5*b* relative to the piston inner 5*a* in the axial direction when the piston outer 5*b* has reached the low compression ratio position L, and the piston outer high compression ratio position latching means 30*b* latching the piston outer 5*b* relative to the piston inner 5*a* in the axial direction when the piston outer 5*b* has reached the high compression ratio position H. These latching means 30*a* and 30*b* are explained with reference to FIG. 2, FIG. 4, FIG. 8, FIG. 9, and FIG. 12.

Formed on an inner peripheral face of the piston inner 5*a* at equal intervals in the peripheral direction are a plurality (two in the illustrated embodiment) of first latching channels 31 extending in the peripheral direction and a plurality (the same number as that of the first latching channels 31*a*) of second latching channels 31*b* extending in the peripheral direction below the first latching channels 31*a*. A plurality (the same number as that of the first latching channels 31*a*) of latching levers 32 are mounted swingably in a plurality (the same number as that of the first latching channels 31*a*) of housing grooves 28 in the peripheral wall of the piston inner 5*a* via pivot shafts 33. Each latching lever 32 includes first and second arms 32*a* and 32*b* extending in opposite directions from each other from the swing center, and this latching lever 32 is connected to driving means 39 that makes the lever 32 swing so that the first arm 32*a* and the second arm 32*b* are alternately engaged respectively with the first latching channel 31*a* when the piston outer 5*b* has reached the low compression ratio position L and the second latching channel 31*b* when the piston outer 5*b* has reached the high compression ratio position H.

The driving means 39 is formed from a coil-form operating spring 34 that is disposed between the base of the housing groove 28 and the first arm 32*a* and urges the first arm 32*a* in a direction in which it is engaged with the first latching channel 31*a*, and a hydraulic piston 38 that is fitted into a cylinder hole 36 formed in the piston inner 5*a* and abuts against the tip of the second arm 32*b* so as to push it toward the second latching channel 31*b*. In this arrangement, a positioning projection 35 is formed on the first arm 32*a* so as to prevent the operating spring 34 from moving around.

Figure 12:
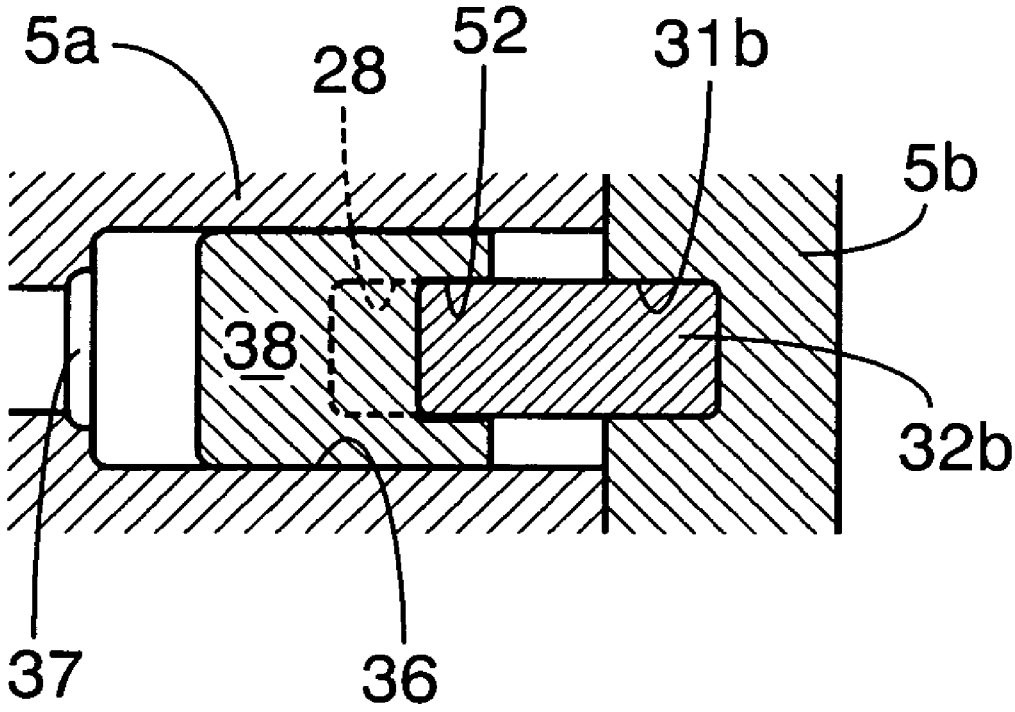
FIG. 12 is a sectional view along line 12-12 in FIG. 9, and FIGS. 13A to 13C are diagrams, corresponding to FIGS. 11A to 11C, of a second embodiment of the present invention.

As shown in FIG. 12 in particular, the cylinder hole 36 of the piston inner 5*a* is formed by cutting away opposite side walls of the housing groove 28 at a diameter larger than that of the groove width of the housing groove 28 so that the cylinder hole 36 opens on an outer peripheral face of the piston inner 5*a*, and the tip of a hydraulic piston 38 fitted into the cylinder hole 36 is provided with a cutout 52 that receives the tip of the second arm 32*b*. Therefore, even when a part of the hydraulic piston 38 is exposed within the housing groove 28, since the whole length of the hydraulic piston 38 can be supported on the inner peripheral face of the cylinder hole 36, and the load of the second arm 32*b* acts on an axially middle point of the hydraulic piston 38, the operation of the hydraulic piston 38 can be stabilized.

Defined in each of the cylinder holes 36 is a second hydraulic chamber 37, which the inner end of the corresponding piston 38 faces. When hydraulic pressure is supplied to this second hydraulic chamber 37, the hydraulic piston 38 receives the hydraulic pressure and pushes the second arm 32*b* so as to swing the latching lever 32 against the force of the operating spring 34, and after the first arm 32*a* is disengaged from the first latching channel 31*a* the second arm 32*b* can engage with the second latching channel 31*b*. When the hydraulic pressure of the second hydraulic chamber 37 is released, the latching lever 32 is now made to swing by the urging force of the operating spring 34, and after the second arm 32*b* is disengaged from the second latching channel 31*b* the first arm 32*a* can engage with the first latching channel 31*a*.

In this way, the first latching channel 31*a*, the first arm 32*a*, and the driving means 39 form the piston outer low compression ratio position latching means 30*a*, and the second latching channel 31*b*, the second arm 32*b*, and the driving means 39 form the piston outer high compression ratio position latching means 30*b*. The driving means 39 is therefore shared between the two latching means 30*a* and 30*b*.

Figure 4:
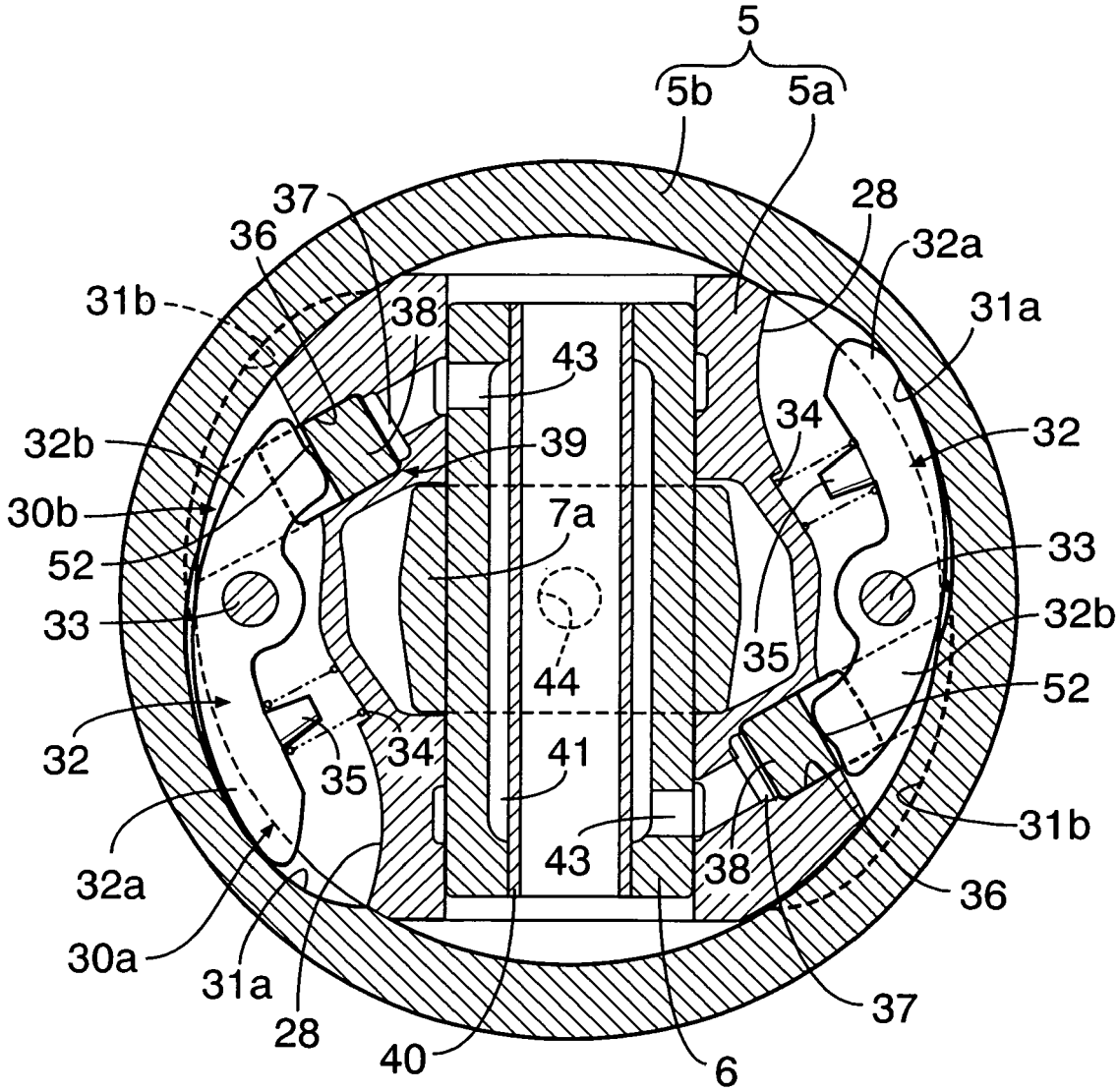
FIG. 4 is a sectional view along line 4-4 in FIG. 2.
Figure 5:
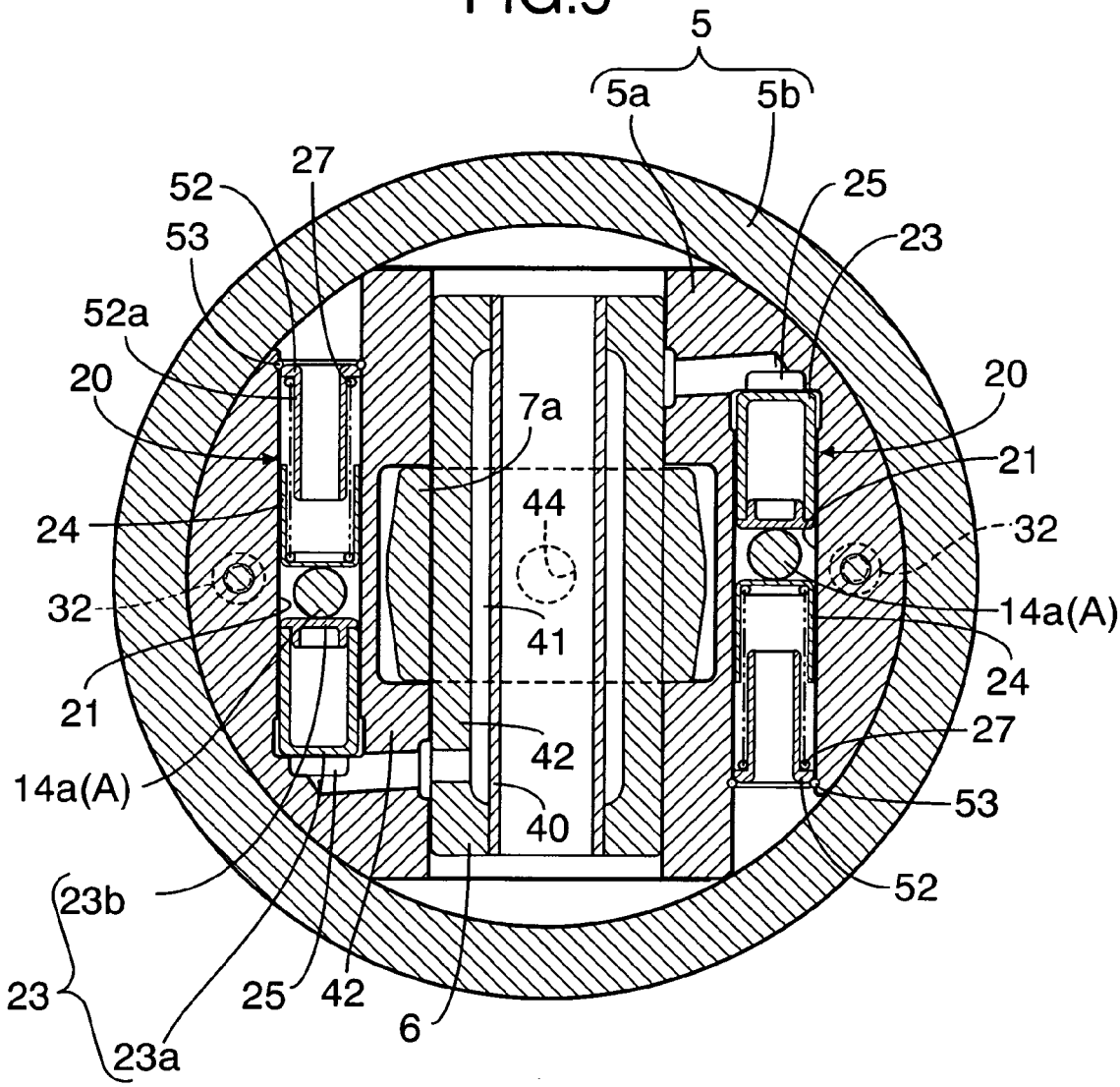
FIG. 5 is a sectional view along line 5-5 in FIG. 2.

As shown in FIG. 4 and FIG. 5, a tubular oil chamber 41 is defined between the piston pin 6 and a sleeve 40 press-fitted into a hollow portion of the piston pin 6, and first and second oil distribution passages 42 and 43 providing communication between the oil chamber 41 and the first and second hydraulic chambers 25 and 37 are provided across the piston pin 6 and the piston inner 5*a*. As shown in FIG. 1, the oil chamber 41 is connected to an oil passage 44 provided across the piston pin 6, the connecting rod 7, and the crankshaft 9, and this oil passage 44 is connected switchably to a hydraulic source oil pump 46 and an oil reservoir 47 via a solenoid switch valve 45.

The operation of the first embodiment is now explained.

In order, for example, to obtain a low compression ratio so as to avoid knocking when the internal combustion engine E is accelerating rapidly, the solenoid switch valve 45 is put into a non-energized state as shown in FIG. 1, thus providing communication between the oil passage 44 and the oil reservoir 47. By so doing, since the first hydraulic chamber 25 and the second hydraulic chamber 37 are both open to the oil reservoir 47 via the oil chamber 41 and the oil passage 44, as shown in FIG. 5 the return plunger 24 pushes the pressure-bearing pin 14*a* in the actuator 20 by means of the urging force of the return spring 27, thus pivoting the raising member 14 to the non-raised position A, in the piston outer low compression ratio position latching means 30*a* the first arm 32*a* is urged toward the inner peripheral face of the piston inner 5*a* by means of the urging force of the operating spring 34, and accompanying this in the piston outer high compression ratio position latching means 30*b* the second arm 32*b* disengages from the second latching channel 31*b*.

Figure 11A:
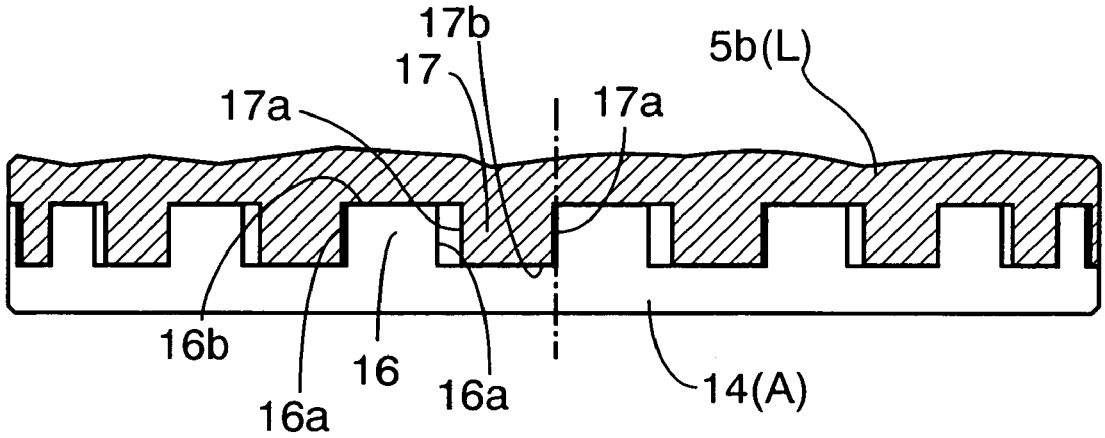
Figure 11B:
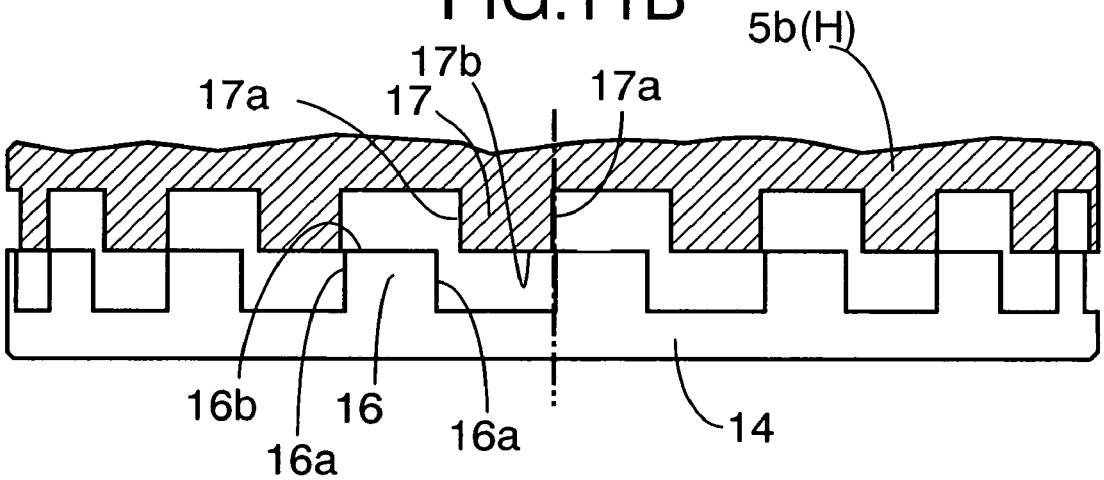

As a result, as shown in FIG. 11A, since the first cams 16 and the second cams 17 of the cam mechanism 15 are positioned with their top parts displaced from each other, when the piston outer 5*b* is pushed against the piston inner 5*a* by means of the pressure on the combustion chamber 4*a* side during the engine expansion stroke or compression stroke, when the piston outer 5*b* is pushed against the piston inner 5*a* by means of frictional resistance occurring between the piston rings 10*a* to 10*c* and the inner face of the cylinder bore 2*a* during the upward stroke of the piston 5, or when the piston outer 5*b* is pushed against the piston inner 5*a* by virtue of the inertial force of the piston outer 5*b* accompanying deceleration of the piston inner 5*a* during the second half of the downward stroke of the piston 5, the piston outer 5*b* is able to descend relative to the piston inner 5*a* down to the low compression ratio position L while making the first cams 16 and the second cams 17 mesh with each other. During this process, since the first arm 32*a* of the latching lever 32 axially supported by the piston inner 5*a* and the first latching channel 31 of the piston outer 5*b* face each other, the latching lever 32 swings by virtue of the urging force of the operating spring 34, and the first arm 32*a* is made to engage with the first latching channel 31 (see FIG. 2 and FIG. 4), thereby holding the piston outer 5*b* at the low compression ratio position L. As a result, there is no play in the cam mechanism 15, and the piston inner and outer 5*a* and 5*b* are able to move up and down as a unit within the cylinder bore 2*a* while giving a low compression ratio.

Figure 9:
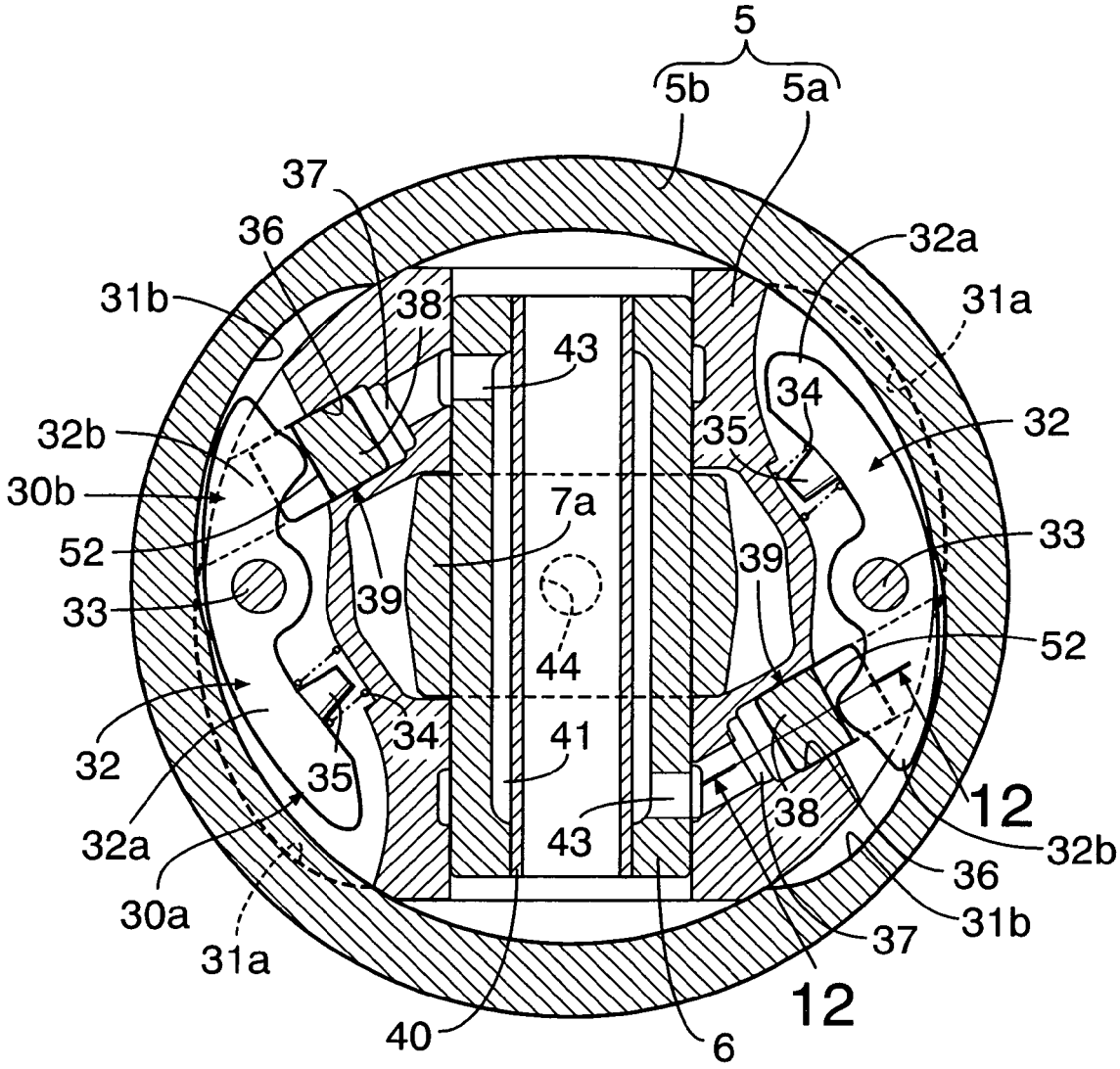
FIG. 9 is a sectional view along line 9-9 in FIG. 8.

Furthermore, in order, for example, to obtain a high compression ratio so as to increase the output when the internal combustion engine E is running at high speed, the solenoid switch valve 45 is energized, and the oil passage 44 is connected to the oil pump 46. By so doing, since hydraulic pressure output from the oil pump 46 is supplied to the first hydraulic chamber 25 and the second hydraulic chamber 37 via the oil passage 44 and the oil chamber 41, as shown in FIG. 9, the hydraulic piston 38 first of all receives the hydraulic pressure of the second hydraulic chamber 37 and makes the latching lever 32 swing against the urging force of the operating spring 34, thus disengaging the first arm 32*a* from the first latching channel 31*a* and pushing the second arm 32*b* toward the inner peripheral face of the piston outer 5*b*. When the first arm 32*a* disengages from the latching channel 31, movement of the piston outer 5*b* to the high compression ratio position H is allowed.

The piston outer 5*b* moves to the high compression ratio position H by virtue of the action of the following types of spontaneous external force. That is, when the piston outer 5*b* is drawn toward the combustion chamber 4*a* by virtue of the intake negative pressure during the engine intake stroke, when the piston outer 5*b* is left behind from the piston inner 5*a* by virtue of frictional resistance occurring between the piston rings 10*a* to 10*c* and the inner face of the cylinder bore 2*a* during the downward stroke of the piston 5, or when the piston outer 5*b* attempts to become detached from the piston inner 5*a* by virtue of the inertial force of the piston outer 5*b* accompanying deceleration of the piston inner 5*a* during the second half of the upward stroke of the piston 5, the piston outer 5*b* rises from the piston inner 5*a*, and the piston outer 5*b* stops ascending at a predetermined high compression ratio position H as a result of the stopper ring 18 in the lower end part of the piston outer 5*b* abutting against the lower end face of the piston inner 5*a* (see FIG. 11B).

Figure 11C:
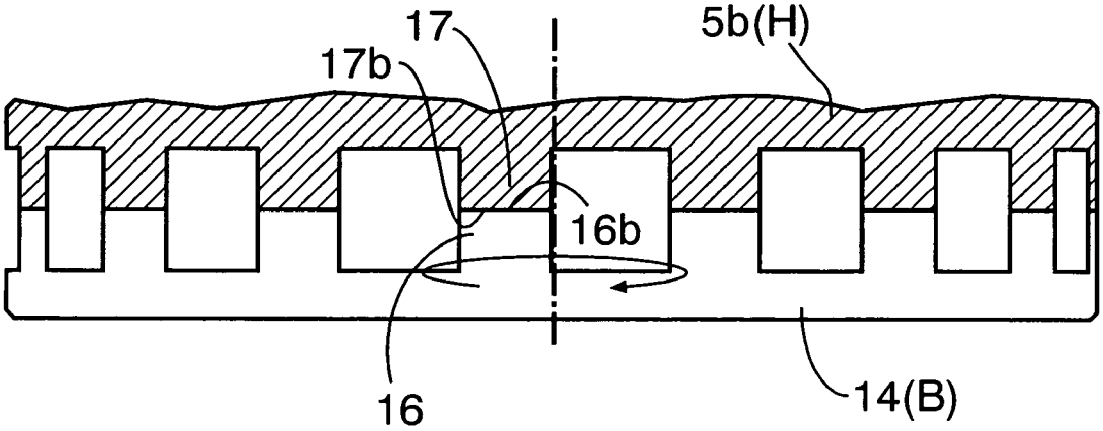

In this way, when the piston outer 5*b* has reached the high compression ratio position H, since in the actuator 20 the operating plunger 23 has already received the hydraulic pressure of the first hydraulic chamber 25 and pushed the pressure-bearing pin 14*a* toward the raised position B, as shown in FIG. 10 the raising member 14 is pivoted from the non-raised position A to the raised position B by means of the pushing force; as shown in FIG. 11C the flat top faces 16*b* and 17*b* of the cams 16 of the raising member 14 and the cams 17 of the piston outer 5*b* are made to abut against each other (see FIG. 11C), and the piston outer 5*b* can thus be held at the high compression ratio position H.

As described above, when the piston outer 5*b* has reached the high compression ratio position H, since the second latching channel 31*b* of the piston outer 5*b* faces the second arm 32*b* of the latching lever 32, the second arm 32*b* is engaged with the second latching channel 31*b* by means of the pushing force of the hydraulic piston 38 (FIG. 8 and FIG. 9), thus preventing relative axial movement of the piston inner 5*a* and the piston outer 5*b*. Therefore, when the piston outer 5*b* is moved from the low compression ratio position L to the high compression ratio position H by virtue of a spontaneous external force, even if there is a delay in movement of the raising member 14 to the raised position B and the piston outer 5*b* receives a kick due to impulsive contact of the stopper ring 18 against the lower end face of the piston inner 5*a*, since the kick is borne by the second arm 32*b*, the piston outer 5*b* can be prevented from bouncing back from the high compression ratio position H and can be held reliably at the high compression ratio position H.

When the raising member 14 pivots to the raised position B, there is no play in the cam mechanism 15, and the piston inner and outer 5*a* and 5*b* can move up and down as a unit within the cylinder bore 2*a* while giving a high compression ratio.

When the piston outer 5*b* moves between the low compression ratio position L and the high compression ratio position H, since rotation thereof relative to the piston inner 5*a* is restricted by the spline teeth 11*a* and the spline grooves 11*b*, which are formed on mating faces of the piston inner 5*a* and the piston outer 5*b* and slidably engage with each other, it is possible to made the shape of the top face of the piston outer 5*b* facing the combustion chamber 4*a* match the shape of the combustion chamber 4*a*, thereby enhancing effectively the compression ratio when the piston outer 5*b* is at the high compression ratio position H. Moreover, when the piston outer 5*b* is at the high compression ratio position H, a large thrust that the piston outer 5*b* receives from the combustion chamber 4*a* during the engine expansion stroke acts perpendicularly on the flat top faces 16*b* and 17*b* of the first cams 16 and the second cams 17, which abut against each other, and the raising member 14 is not be pivoted by the thrust. As a consequence, the hydraulic pressure supplied to the first hydraulic chamber 25 does not need to have such a high pressure as to be able to counterbalance the thrust, and even when there are some bubbles in the first hydraulic chamber 25, since the piston outer 5*b* can be held stably at the high compression ratio position H, there are no problems.

Moreover, since movement of the piston outer 5*b* between the low compression ratio position L and the high compression ratio position H utilizes a spontaneous external force, which acts on the piston inner and outer 5*a* and 5*b* during reciprocation of the piston 5 so as to make the piston inner and outer 5*a* and 5*b* move toward or away from each other in the axial direction, the actuator 20 is required only to exhibit an output for simply pivoting the raising member 14 between the non-raised position A and the raised position B, thereby enabling the capacity and dimensions of the actuator 20 to be reduced.

Among the above-mentioned spontaneous external forces, the frictional resistance between the piston rings 10*a* to 10*c* and the inner face of the cylinder bore 2*a* and the inertial force of the piston outer 5*b* are particularly effective. Since the above-mentioned frictional resistance changes relatively little in response to a change in rotational speed of the engine whereas the inertial force of the piston outer 5*b* increases in response to an increase in the rotational speed of the engine in the manner of a quadratic curve, for switching the position of the piston outer 5*b* the frictional resistance is dominant in a low rotational speed region of the engine, and the inertial force of the piston outer 5*b* is dominant in a high rotational speed region of the engine.

Furthermore, since each of the actuators 20 is formed from the operating plunger 23, which is operated by the hydraulic pressure of the first hydraulic chamber 25 and which is capable of pivoting the raising member 14 from the non-raised position A to the raised position B, and the return plunger 24, which is operated by the urging force of the return spring 27 when the hydraulic pressure of the first hydraulic chamber 25 is released and which is capable of returning the raising member 14 from the raised position B to the non-raised position A, it is necessary to employ only one hydraulic pressure chamber 25 per actuator 20, thus simplifying the arrangement thereof.

Moreover, since the first and second arms 32*a* and 32*b* at opposite ends of the latching lever 32 axially supported by the piston inner 5*a* are members forming the piston outer low compression ratio position latching means 30*a* and the piston outer high compression ratio position latching means 30*b*, it is possible to simplify the arrangement of the latching means 30*a* and 30*b*. Furthermore, since the latching means 30*a* and 30*b* have the common driving means 39, it is possible to further simplify the arrangement thereof. Moreover, since the driving means 39 is formed from the operating spring 34 and the hydraulic piston 38 pushing the first and second arms 32*a* and 32*b* respectively, it is necessary to employ only one second hydraulic chamber 37 for applying hydraulic pressure to the hydraulic piston 38, and the arrangement thereof is also simple.

Furthermore, since the first and second hydraulic chambers 25 and 37 are connected switchably to the oil pump 46 and the oil reservoir 47 via the common solenoid switch valve 45, the actuator 20 and the piston outer latching means 30 can be operated efficiently with common hydraulic pressure, the hydraulic pressure circuit can be simplified, and the variable compression ratio system can be provided at low cost.

Moreover, since the plurality of actuators 20 are arranged at equal intervals in the peripheral direction on the raising member 14, a biased load is not applied to the raising member 14, and it can be pivoted smoothly around the pivot portion 12; furthermore, since the total output of the plurality of actuators 20 is high, it is possible to reduce the capacity and consequently the dimensions of each of the actuators 20.

Furthermore, since the operating plunger 23 and the return plunger 24, which are components of each of the actuators 20, are fitted in the common cylinder hole 21 formed in the piston inner 5*a*, the structure is simple, and machining of the holes is simple, thus contributing to a reduction in cost.

Moreover, when two actuators 20 are provided, each of the cylinder holes 21 is formed in the piston inner 5*a* in parallel to the piston pin 6, and the two actuators 20 can be arranged at equal intervals in the peripheral direction of the raising member 14 in the confined interior of the piston inner 5*a* without interfering with the piston pin 6.

Furthermore, since the axes of the operating and return plungers 23 and 24 are arranged so as to be substantially orthogonal to a radius of the pivot portion 12 that intersects the axis of the corresponding pressure-bearing pin 14*a*, the pushing forces of the operating and return plungers 23 and 24 can be transmitted efficiently to the raising member 14 via the pressure-bearing pins 14, thus contributing to making the actuator 20 compact.

Moreover, since end faces of the operating and return plungers 23 and 24 are in line contact with a cylindrical outer peripheral face of the pressure-bearing pin 14*a*, the contact area is relatively large, thus decreasing the plane pressure and contributing to an improvement of the durability.

A second embodiment of the present invention is now explained with reference to FIG. 13A to FIG. 13C.

Figure 13A:
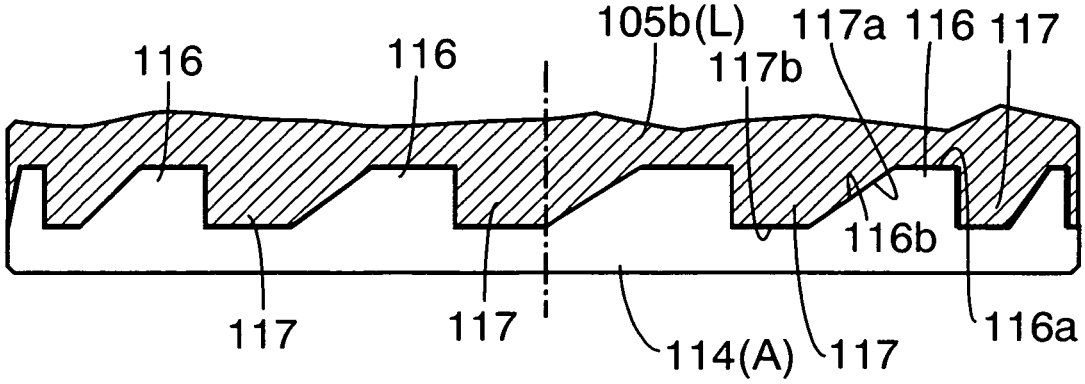
Figure 13B:
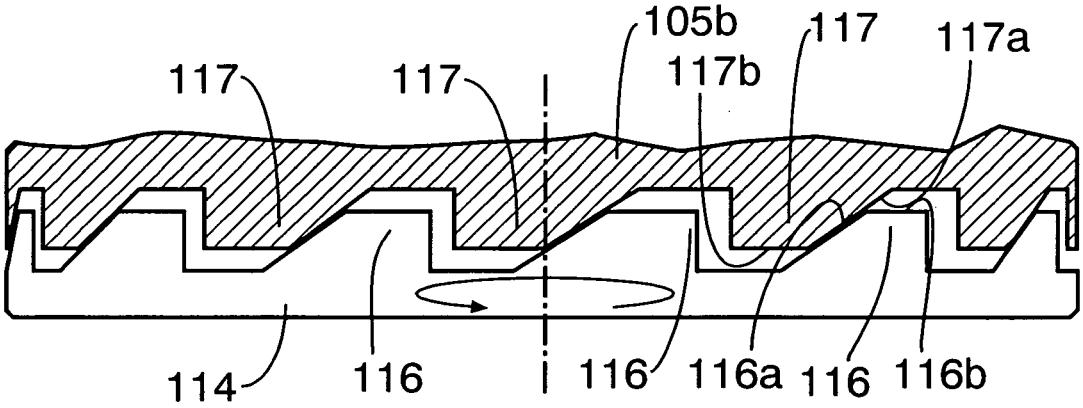
Figure 13C:
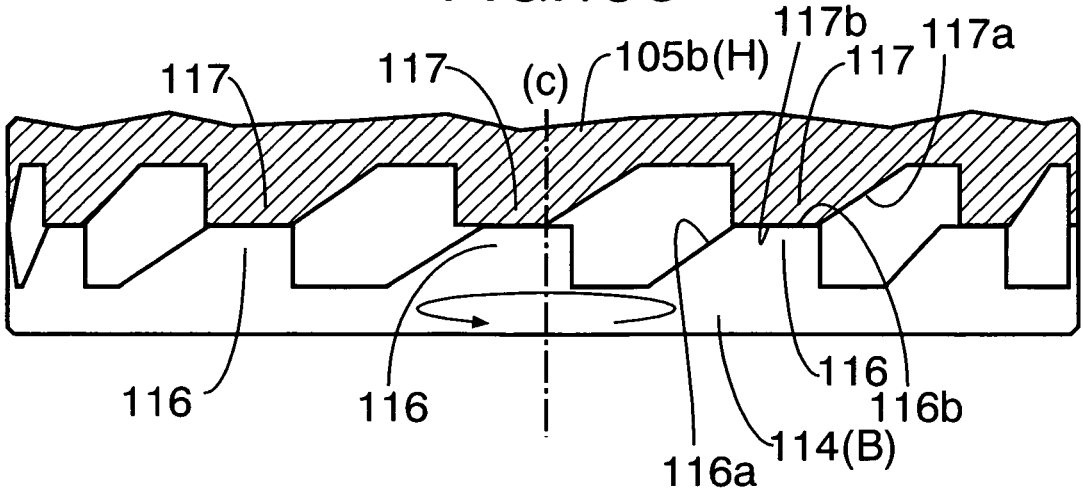

The second embodiment has the same arrangement as that of the preceding embodiment except that a first cam 116 and a second cam 117 formed on a raising member 114 and a piston outer 105*b* respectively are provided with inclined faces 116*a* and 117*a* which slide away from each other in the axial direction when a raising member 114 pivots from a non-raised position A to a raised position B, and in FIG. 13A to FIG. 13C parts corresponding to the parts of the preceding embodiment are denoted by reference numerals and symbols that are obtained by adding 100 to the corresponding reference numerals and symbols of the preceding embodiment, thereby avoiding duplication of the explanation.

In the second embodiment, since one side of each of the cams 116 and 117 is the inclined face 116*a* or 117*a*, compared with the preceding embodiment, the gap between adjacent cams 116 and adjacent cams 117 is widened, the operating stroke angle of the raising member 114 increases, and the area of each of the top faces 116*b* and 117*b* of the cams 116 and 117 decreases, but even when the spontaneous external force for moving the piston outer 105*b* to a high compression ratio position H is weak, if a pivoting force is applied to the raising member 114 in order to pivot it to the raised position B by means of an actuator, which is not illustrated, the mutual lifting action of the inclined faces 116*a* and 117*a* enables the piston outer 105*b* to be pushed up to the high compression ratio position H.

The present invention is not limited to the above-mentioned embodiments, and can be modified in a variety of ways without departing from the spirit and scope of the present invention. For example, the operating mode of the solenoid switch valve 45 can be the opposite of that of the above-mentioned embodiments. That is, an arrangement is possible in which, when the switch valve 45 is in a nonenergized state, the oil passage 44 is connected to the oil pump 46, and when it is in an energized state, the oil passage 44 is connected to the oil reservoir 47.

The invention claimed is:

1. An internal combustion engine variable compression ratio system comprising:

a piston inner (5*a*) connected to a connecting rod (7) via a piston pin (6);

a piston outer (5*b*, 105*b*) that, while being fitted around the outer periphery of the piston inner (5*a*) so that it can slide only in the axial direction and having an outer end face thereof facing a combustion chamber (4*a*), is capable of moving between a low compression ratio position (L) close to the piston inner (5*a*) and a high compression ratio position (H) close to the combustion chamber (4*a*);

a raising member (14, 114) that is disposed between the piston inner and the piston outer (5*a*, 5*b*), pivots around axes of the piston inner and the piston outer (5*a*, 5*b*) between a non-raised position (A) at which movement of the piston outer (5*b*, 105*b*) to the low compression ratio position (L) is allowed and a raised position (B) at which the piston outer (5*b*, 105*b*) is held at the high compression ratio position (H), and allows, at the non-raised position (A), movement of the piston outer (5*b*, 105*b*) between the low compression ratio position (L) and the high compression ratio position (H) by virtue of a spontaneous external force;

an actuator (20) connected to the raising member (14, 114);

piston outer stopper means (18) that is provided between the piston inner (5*a*) and the piston outer (5*b*, 105*b*), prevents movement of the piston outer (5*b*, 105*b*) beyond the high compression ratio position (H), and allows movement of the piston outer (5*b*, 105*b*) toward the low compression ratio position (L); and piston outer low compression ratio position latching means (30*a*) that is disposed between the piston inner (5*a*) and the piston outer (5*b*, 105*b*) and operates, when the piston outer (5*b*, 105*b*) has reached the low compression ratio position (L), so as to prevent relative axial movement of the piston inner (5*a*) and the piston outer (5*b*, 105*b*);

the system further comprising piston outer high compression ratio position latching means (30*b*) that is disposed between the piston inner (5*a*) and the piston outer (5*b*, 105*b*) and operates, when the piston outer (5*b*, 105*b*) has reached the high compression ratio position (H), so as to prevent relative axial movement of the piston inner (5*a*) and the piston outer (5*b*, 105*b*).

2. The internal combustion engine variable compression ratio system according to claim 1, wherein the piston outer high compression ratio position latching means (30*b*) comprises a peripheral first latching channel (31*a*) formed on an inner peripheral face of the piston outer (5*b*, 105*b*), a first latching member (32*a*) that is supported by the piston inner (5*a*) and moves between an operating position where it can engage with the first latching channel (31*a*) when the piston outer (5*b*, 105*b*) has reached the high compression ratio position (H) and a retracted position where it disengages from the first latching channel (31*a*), and driving means (39) for driving the first latching member (32*a*) to these two positions, and the piston outer low compression ratio position latching means (30*a*) comprises a peripheral second latching channel (31*b*) formed on an inner peripheral face of the piston outer (5*b*, 105*b*), a second latching member (32*b*) that is supported by the piston inner (5*a*) and moves between an operating position where it can engage with the second latching channel (31*b*) when the piston outer (5*b*, 105*b*) has reached the low compression ratio position (L) and a retracted position where it disengages from the second latching channel (31*b*), and driving means (39) for driving the second latching member (32*b*) to these two positions.

3. The internal combustion engine variable compression ratio system according to claim 2, wherein the first and second latching members comprise a first arm (32*a*) and a second arm (32*b*) respectively that extend in opposite directions from each other from the center of swing of a single latching lever (32) swingably and axially supported by the piston inner (5*a*), and the latching lever (32) is swung by single driving means (39) so as to make the first and second arms (32*a*, 32*b*) engage alternately with the first and second latching channels (31*a*, 31*b*).

4. The internal combustion engine variable compression ratio system according to claim 3, wherein the driving means (39) comprises an operating spring (34) that urges one of the first and second arms (32*a*, 32*b*) in a direction in which it engages with the corresponding latching channel (31*a*, 31*b*), and a hydraulic piston (38) that is capable of receiving a hydraulic pressure from a hydraulic pressure source (46) and pushing the other of the first and second arms (32*a*, 32*b*) in a direction in which it engages with the corresponding latching channel (31*a*, 31*b*).

* * * * *